US005920952A

United States Patent [19]

Baldacci

[11] Patent Number: 5,920,952

[45] Date of Patent: Jul. 13, 1999

[54] STEAM-CLEANING APPLIANCE

[75] Inventor: Lapo Baldacci, Florence, Italy

[73] Assignee: Ariete S.p.A., Florence, Italy

[21] Appl. No.: 08/996,295

[22] Filed: Dec. 22, 1997

[51] Int. Cl.[6] ..... A47L 11/03

[52] U.S. Cl. ..... 15/320; 15/393; 392/473; 219/628

[58] Field of Search ..... 15/320, 321, 322, 15/50.1, 98, 393; 392/444, 447, 477, 473, 476; 219/628

[56] References Cited

U.S. PATENT DOCUMENTS

| | | | |
|---|---|---|---|
| 1,527,224 | 2/1925 | Riordan | 15/320 |
| 1,801,135 | 4/1931 | Blogg | 15/320 |
| 1,803,693 | 5/1931 | Cutting | 15/320 |
| 3,061,959 | 11/1962 | Blumenfeld | 15/320 |
| 3,755,850 | 9/1973 | Porter | 15/320 |
| 4,308,636 | 1/1982 | Davis | 15/321 |
| 4,696,074 | 9/1987 | Cavalli | 15/321 |
| 5,502,872 | 4/1996 | Chae et al. | 15/320 |

FOREIGN PATENT DOCUMENTS

| | | | |
|---|---|---|---|
| 80214 | 2/1951 | Czechoslovakia | 15/320 |
| 0 458 542 A1 | 11/1991 | European Pat. Off. . | |
| 30 31 263 A1 | 2/1982 | Germany . | |
| 2091992 | 8/1982 | United Kingdom | 15/320 |

*Primary Examiner*—Gary K. Graham
*Attorney, Agent, or Firm*—Larson & Taylor

[57] ABSTRACT

A steam cleaning appliance comprising a head element hingedly connected at one end to a handle. Said head element comprise a housing provided with a base member, accomodating a boiler. Said boiler is provided with a dome portion communicating through a conduit with a manifold housed in a cavity formed in the outer side of the base member, said manifold being provided with a plurality of steam dispensing holes. A cloth is removably attached to the outer side of said base member by means of attachment means.

9 Claims, 3 Drawing Sheets

STEAM-CLEANING APPLIANCE

BACKGROUND OF THE INVENTION

The present invention relates to household steam-cleaning appliances.

Steam-cleaning appliances are available on the market comprising a boiler which is connected, via a flexible tube, to a tool that uses the jet of steam produced in the boiler for cleaning purposes. These devices are generally designed for cleaning large areas and the steam used is usually under pressure so that it can be conveyed from the boiler to the cleaning tool. Although this type of household appliance is undoubtedly very efficient at dissolving dirt by means of the steam, it has a number of drawbacks.

Firstly, the boiler can be fairly bulky when working in rather small spaces. Furthermore, the use of pressurized steam means that filling the boiler—as well as refilling it as and when necessary—is a fairly complex operation and casts doubts over the overall safety of the device.

The object of the present invention is therefore to provide a steam-cleaning appliance that is very easy to manoeuvre, compact, extremely simple to use and one in which filling the boiler is completely safe.

SUMMARY OF THE INVENTION

The object of the present invention is, therefore, a steam-cleaning appliance comprising a boiler fitted with heating means, steam dispensing means which are connected to the said boiler, and a cleaning tool comprising a head and a handle element, characterized in that the said boiler and the said steam dispensing means are located in the said head.

The said dispensing means comprise a manifold with a plurality of holes which is connected to the said boiler by means of a conduit connected at one end to the said manifold, the free end of the said conduit communicating with the dome of the said boiler.

BRIEF DESCRIPTION OF THE DRAWING

Additional advantages and features of the device according to the present invention will be apparent from the following description of an embodiment of the latter, given by way of non-limiting example, with reference to the appended drawings, in which.

DESCRIPTION OF THE PREFERRED EMBODIMENT OF THE INVENTION

Figure 1:
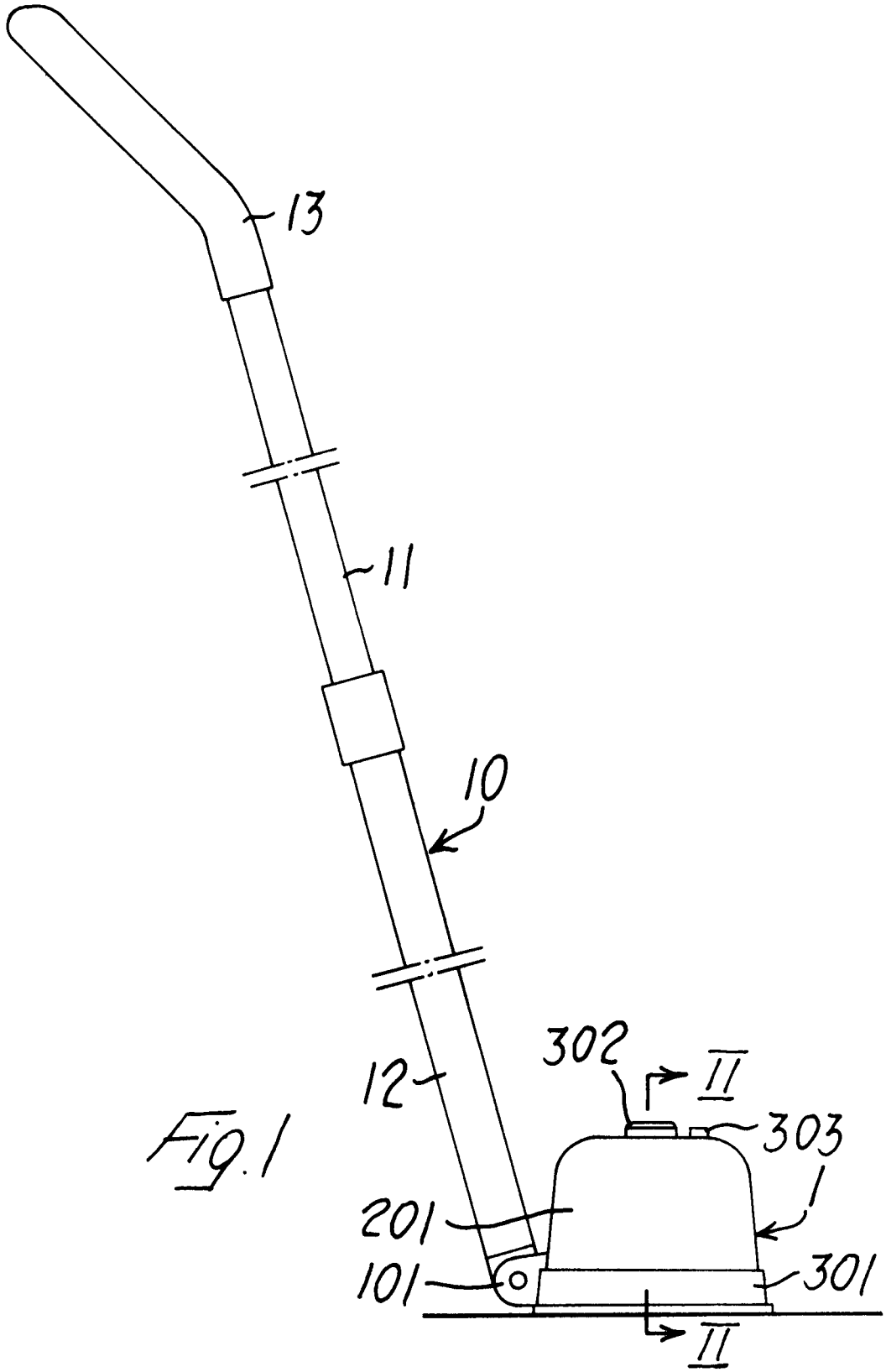
FIG. 1 is a side view of the steam-cleaning appliance according to the present invention.

FIG. 1 shows the steam-cleaning appliance according to the present invention; the reference numeral 1 denotes the head of the said appliance. The said head 1 comprises a housing 201 and a base 301 is fitted with a handle element 10. The stopper 302 for the boiler and the thermostat indicator light 303, which will both be described in greater detail below, are also located on the housing 201. The handle element 10 is hinged to the portions 101 which project from the said head 1 and comprises two telescopic tubular elements 11 and 12 which can be extended with respect to each other, and a hand grip 13 connected to the element 11.

Figure 2:
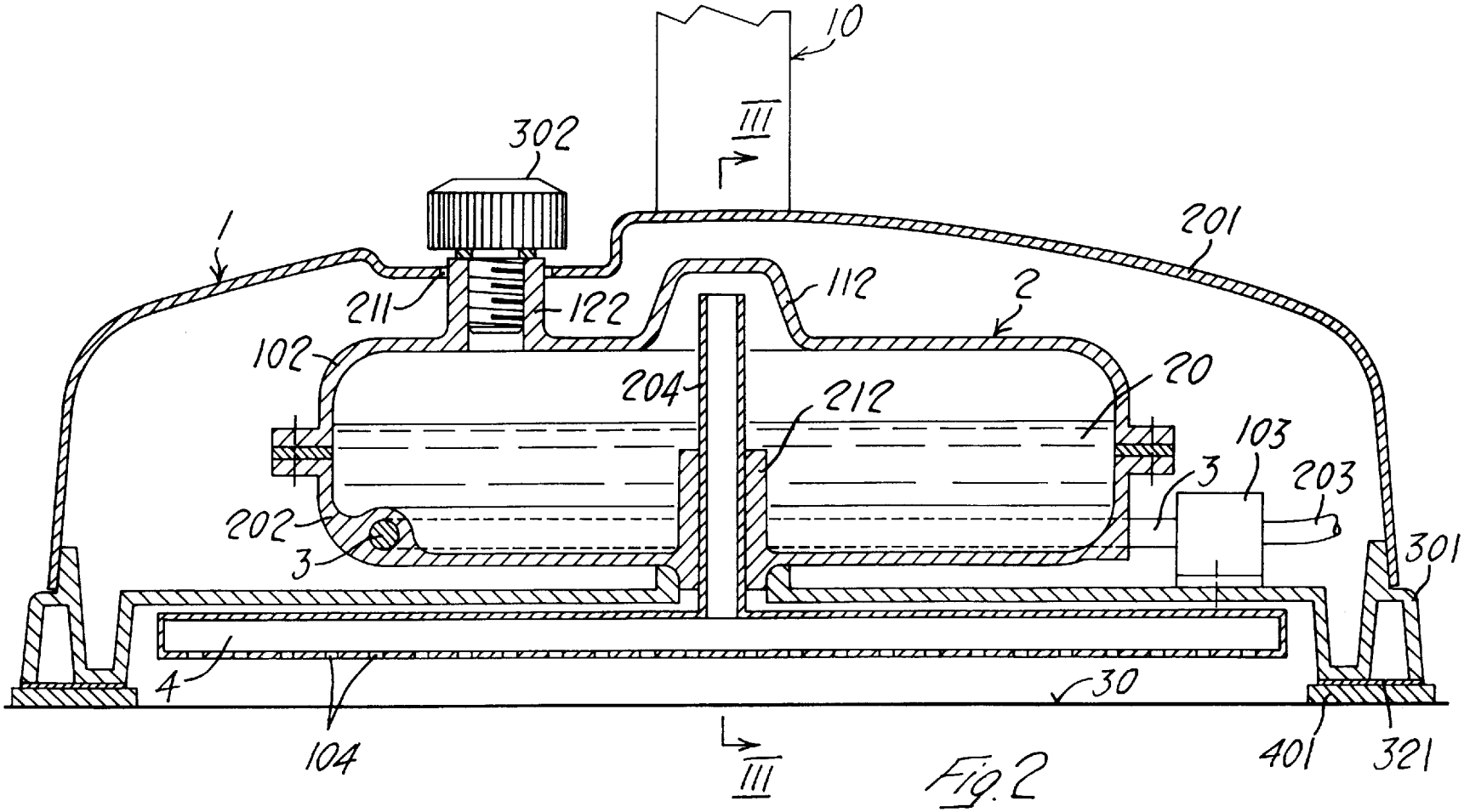
FIG. 2 is an enlarged longitudinal cross-sectional view of the appliance on the plane II—II in FIG. 1.

FIG. 2 illustrates the head of the cleaning appliance according to the invention in a cross-section on II—II in FIG. 1. The head 1 comprises the housing 201, the bottom of which is connected to the base 301, the cloth 401 being secured by means of the strip of velcro 321 to that surface of the base that faces the floor 30. The boiler 2 is located inside the said housing 201. The said boiler 2 comprises two half-shells 102 and 202 which are suitably connected together; the half-shell 202 has an integral axial sleeve 212 which projects both internally and externally with respect to the wall of the said half-shell 202. The end of the said sleeve 212 that projects externally is inserted into the hole 331 in the base 301 of the said head 1. The half-shell 102, on the other hand, has a feed inlet 122 which passes through the hole 211 in the housing and is fitted with a stopper 302. The dome of the boiler 2 consists of the cupola 112 formed in the half-shell 102.

Inserted into the cavity 311 of the base 301 is a tubular manifold 4 with a plurality of holes 104 which is connected, by means of a conduit 204 formed in one piece with the said manifold, to the inside of the boiler via the hole 331 in the base 301 and the sleeve 212 of the boiler 2. The free end of the said conduit 204 actually opens into the cupola 112. The half-shell 202 of the boiler 2 is fitted with the element for heating the water 20 contained therein, in other words with the resistance element 3, which is embedded in the said halfshell and is fitted with a thermostat 103 and an electrical lead 203.

Figure 3:
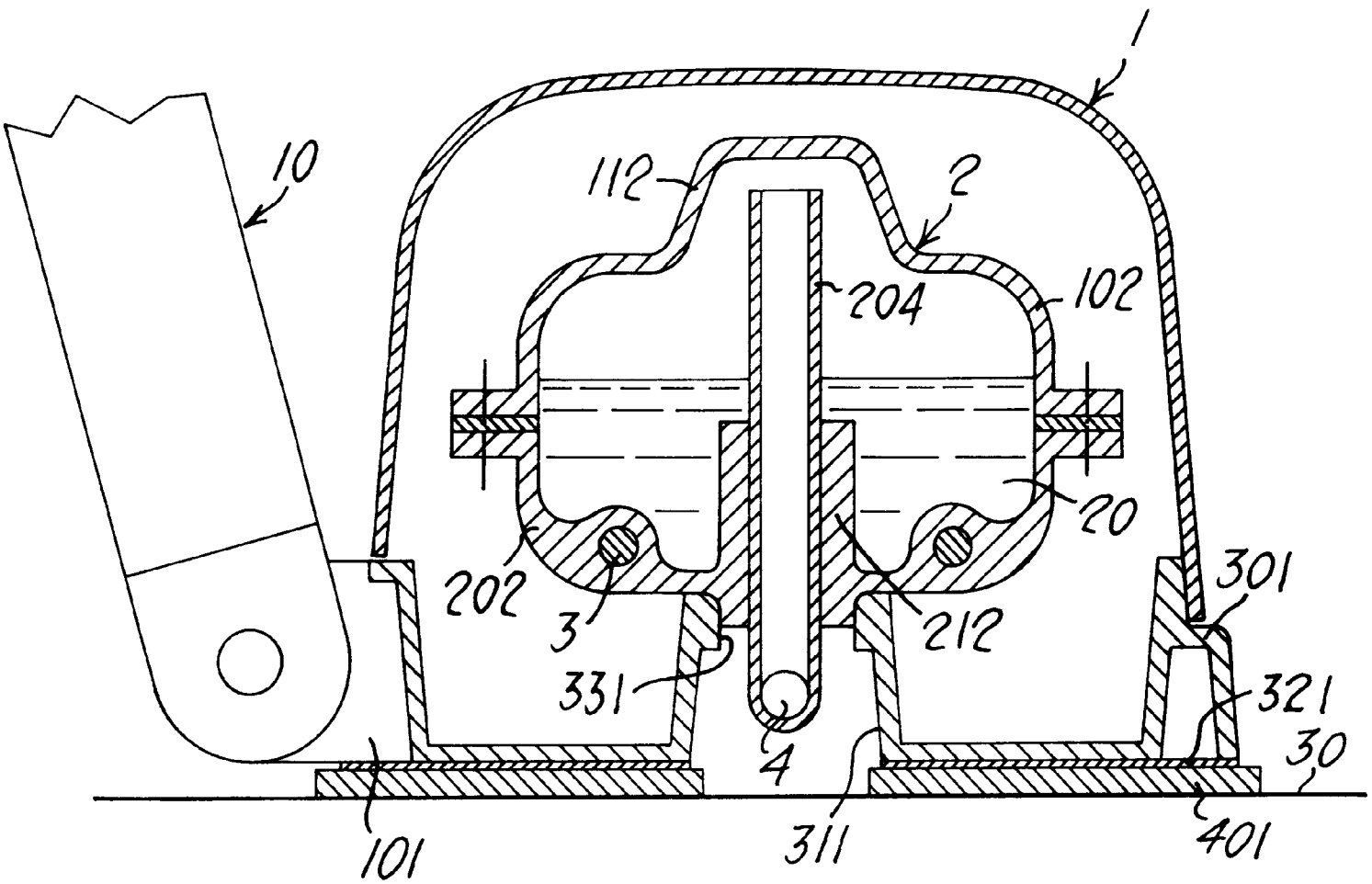
FIG. 3 is a longitudinal cross-sectional view on the plane III—III in FIG. 2.

FIG. 3 illustrates the head 1 of the cleaning appliance according to the invention in cross-section on the plane III—III in FIG. 2; the same reference numerals have been used for identical parts. This figure shows more clearly how the conduit 204 fits inside the boiler 2 and how the resistance element 3 is embedded in the half-shell 202 of the said boiler 2.

The way in which the device according to the present invention works will be evident from the following description. The stopper 302 is removed and the water 20 needed to produce the steam is poured into the boiler 2 via the inlet 122. Once the boiler has been filled and the inlet 122 closed again by means of the stopper 302, the electrical lead 203 can be plugged into the mains. The resistance element 3 can then heat up the water 20 contained in the boiler, the operation being controlled by the thermostat 103 which is fitted with the indicator light 303. The steam produced rises to the top of the cupola 112 of the half-shell 102 of the boiler 2 and can escape from the latter via the conduit 204 connected to the manifold 4. The steam is then dispensed on to the floor 30 surface via the holes 104 in the manifold 4. The dirt on the floor 30 will dissolve with the help of the said steam and can then be removed using the cloth 401 which is attached to the base 301 of the head 1.

It is therefore quite clear that the steam produced in the boiler 2 is not under pressure and that the appliance according to the present invention is therefore far safer to use than devices of a known type. It is thus possible, should the need arise, to refill the boiler 2 with water without the user being in any danger.

Advantageously, the cloth 401 is removably attached to the base 301, for example—and as illustrated in the figures—by means of a strip of velcro 321. The cloth 401 could also be removably secured to the base 301 using other means, for example spring clips.

The cleaning appliance designed in this way is therefore extremely compact, easy to use and much safer than similar known appliances—and yet works just as effectively as the latter. Furthermore, this type of embodiment is undoubtedly more economical both in terms of production costs and in terms of operating costs.

I claim:

1. A steam cleaning appliance comprising:

a head element, said head element including a housing provided with a base member which said base member has a cavity formed in an outer side thereof;

a handle hingedly connected at a distal end thereof to said head element;

a boiler in said housing, said boiler including a dome portion;

an electronic heating means for heating water contained in said boiler;

steam dispensing means for dispensing steam generated in said boiler outwardly through said base member, said dispensing means including (a) a manifold housed in said cavity of said base member and having a plurality of dispensing holes and (b) a conduit communicating said manifold and said dome portion;

a cloth; and an attachment means for removably attaching said cloth to the outer side of said base member.

2. Steam cleaning appliance according to claim 1, in which said attachment means comprise a strip of velcro.

3. Steam cleaning appliance according to claim 1, in which said attachment means comprise spring clips.

4. Steam cleaning appliance according to claim 1, in which said attachment means comprise an elastic strip.

5. A steam cleaning appliance comprising:

a cleaning tool including a) a head, said head having a housing with a base thereon, and said base having a hole therein, b) a handle element attached to said head, c) a cloth, and d) an attachment means for removably attaching said cloth to said base;

a boiler located in said head;

a heating means for heating water in said boiler;

a steam dispensing means located in said head for dispensing steam generated in said boiler through said hole in said base to a surface to be cleaned.

6. A steam cleaning appliance as claimed in claim 5:

wherein said boiler includes a dome therein; and wherein said steam dispensing means includes (a) a manifold having steam dispensing holes, and (b) a conduit passing through said hole in said base and having a connected end connected to said manifold and a free end located in said dome.

7. A steam cleaning appliance as claimed in claim 6, wherein said head further includes a cavity formed by an external surface of said base and in which said manifold is located.

8. A steam cleaning appliance as claimed in claim 5, wherein said attachment means is a strip of velcro.

9. A steam cleaning appliance as claimed in claim 5, wherein said attachment means is spring clips.

* * * * *

US005920952C1

(12) EX PARTE REEXAMINATION CERTIFICATE (4953rd)

United States Patent
Baldacci

(10) Number: US 5,920,952 C1
(45) Certificate Issued: Jun. 29, 2004

(54) STEAM-CLEANING APPLIANCE

(75) Inventor: Lapo Baldacci, Florence (IT)

(73) Assignee: Ariete S.p.A., Settimello di Calenzano (IT)

Reexamination Request:
No. 90/006,332, Jul. 23, 2002

Reexamination Certificate for:
Patent No.: 5,920,952
Issued: Jul. 13, 1999
Appl. No.: 08/996,295
Filed: Dec. 22, 1997

(51) Int. Cl.[7] ..... A47L 11/03
(52) U.S. Cl. ..... 15/320; 15/393; 392/473; 219/628
(58) Field of Search ..... 15/320, 321, 322, 15/50.1, 98, 393; 392/444, 447, 477, 473, 476; 219/628

(56) References Cited

U.S. PATENT DOCUMENTS

| | | | | |
|---|---|---|---|---|
| 4,366,367 | A | 12/1982 | Mazzucco | |
| 4,948,947 | A | 8/1990 | Kang | |
| 5,386,612 | A | 2/1995 | Sham | |
| 5,473,792 | A | 12/1995 | Kent et al. | |
| 5,513,415 | A | 5/1996 | Kent et al. | |
| 5,587,021 | A * | 12/1996 | Hoersch et al. | 134/1 |

FOREIGN PATENT DOCUMENTS

| | | |
|---|---|---|
| DE | 455 692 | 2/1928 |
| EP | 0 182 754 | 5/1986 |
| EP | 0 253 910 | 1/1988 |
| EP | 0 478 508 | 4/1992 |
| EP | 0 672 377 | 9/1995 |
| EP | 0 717 952 | 6/1996 |
| GB | 2 276 811 | 10/1994 |
| IT | 163794 | 7/1983 |
| IT | 1194529 | 12/1983 |
| IT | 202018 | 1/1985 |
| IT | 01238286 | 3/1990 |
| JP | 55-81631 | 6/1980 |
| JP | 63-83160 | 6/1988 |
| JP | 63-129203 | 6/1988 |
| JP | 7-275166 | 10/1995 |

OTHER PUBLICATIONS

Goblin Elle, *The Block–House,* Autumn–Winter 1991–1992, p. 1093.
The Astutes DOMENA, A Comfortable Proposal, p. 40.
Le Catalogue La Redoute, p. 1161.

* cited by examiner

*Primary Examiner*—Terrence R. Till

(57) ABSTRACT

A steam cleaning appliance comprising a head element hingedly connected at one end to a handle. Said head element comprise a housing provided with a base member, accomodating a boiler. Said boiler is provided with a dome portion communicating through a conduit with a manifold housed in a cavity formed in the outer side of the base member, said manifold being provided with a plurality of steam dispensing holes. A cloth is removably attached to the outer side of said base member by means of attachment means.

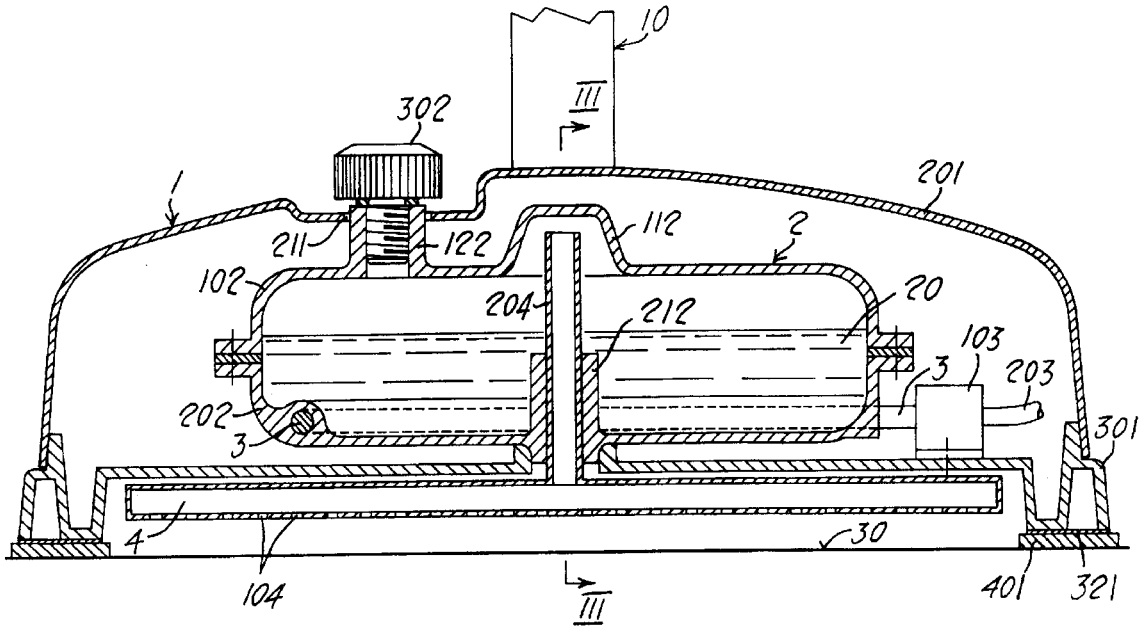

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–4 is confirmed.

Claims 5–7 are determined to be patentable as amended.

Claims 8 and 9, dependent on an amended claim, are determined to be patentable.

5. A steam cleaning appliance comprising:

a cleaning tool including a) a head, said head having a housing with a base thereon, and said base having a [hole] *cavity* therein *which openly faces the surface to be cleaned*, b) a handle element attached to said head, c) [a cloth, and d)] an attachment means for removably attaching [said] *a* cloth to said base;

*d*) a boiler located in said head;

*e*) a heating means for heating water in said boiler;

*f*) a steam dispensing means located in said head for dispensing steam generated in said boiler, *said steam dispensing means including a manifold which receives steam from the boiler and dispenses the steam* through said [hole in said base to a] *cavity onto the* surface to be cleaned*, and*

*g*) *a cloth attachable to the base and open below the cavity to allow steam from the manifold to be dispensed directly onto the surface to be cleaned.*

6. A steam cleaning appliance as claimed in claim 5:

wherein said boiler includes a dome therein; and wherein said steam dispensing means includes [(a) a manifold having steam dispensing holes, and (b)] a conduit [passing through said hole in said base and having a connected end] connected to said manifold and a free end located in said dome.

7. A steam cleaning appliance as claimed in claim [6] *5*, wherein said [head further includes a] cavity *is* formed by [an external surface] *surfaces* of said base [and] in which said manifold is located.

* * * * *